United States Patent [19]

Jewell et al.

[11] Patent Number: 4,706,691

[45] Date of Patent: Nov. 17, 1987

[54] TOBACCO TREATING PROCESS

[75] Inventors: J. N. Jewell, Macon, Ga.; K. R. Korte, Louisville, Ky.; R. H. Marshall, New Albany; K. A. Zipperle, Jeffersonville, both of Ind.

[73] Assignee: Brown & Williamson Tobacco Corporation, Louisville, Ky.

[21] Appl. No.: 851,751

[22] Filed: Apr. 14, 1986

Related U.S. Application Data

[63] Continuation-in-part of Ser. No. 482,756, Apr. 7, 1983, Pat. No. 4,582,070.

[51] Int. Cl.[4] ..... A24B 3/18

[52] U.S. Cl. ..... 131/300; 131/302; 131/303; 131/304; 131/296

[58] Field of Search ..... 131/303, 296, 290, 291, 131/300, 301, 302, 314, 315, 352, 312, 360, 903

*Primary Examiner*—V. Millin

*Attorney, Agent, or Firm*—Charles G. Lamb

[57] ABSTRACT

An improved tobacco treating process for smoking articles including the steps of shredding the tobacco in a disc shredder, controlling the specific energy imparted to the tobacco being shredded to an empirically predetermined value, and processing the shredded tobacco under high humidity drying conditions.

10 Claims, No Drawings

TOBACCO TREATING PROCESS

CROSS REFERENCE TO RELATED APPLICATION

This is a continuation-in-part application of Ser. No. 482,756, now U.S. Pat. No. 4,582,070, filed Apr. 7, 1983, by John N. Jewell entitled "Improved Tobacco Treating Process", assigned to Brown & Williamson Tobacco Corporation.

BACKGROUND OF THE INVENTION

1. Field of the Invention

The invention relates to a process for treating tobacco stems and more particularly relates to a process which involves the steps of shredding the tobacco in a disc shredder while controlling the specific energy imparted to the tobacco by the disc shredder and drying the shredded tobacco under high humidity conditions.

2. Brief Description of the Prior Art

In the manufacture of smoking articles which include some preselected percentage of tobacco stems, it is the usual practice to moisten such stems to minimize shattering and provide a material of more uniform particle size prior to reducing the stems to a particle size of a preselected dimension appropriate for preparing the smoking articles in which the stems are to be included. After the stems have been moistened and reduced to the preselected particle size, it also is necessary to reduce the moisture content of the tobacco stems to a level below that in which the size reduction is conducted.

One of the manners of reducing stems to a preselected particle size is by shredding the stems prior to further treatment in order to fiberize the stem and provide increased filling capacity. Various methods are known in the art to accomplish this shredding reduction. For example, the now expired U.S. Pat. No. 3,204,641 issued to S. O'Brien Jones on Sept. 7, 1965, teaches a method of producing tobacco leaf stems by adjusting the moisture content of the stems in the percentage range of about 40% to about 65% by weight and then shredding the moistened stems to a preselected size suitable for cigarettes before drying the material to a moisture content suitable for use in cigarettes. U.S. Pat. No. 4,094,323 issued to Frazier et al, on June 13, 1978, teaches a method of moistening tobacco stems in a percentage range from about 10% to about 50% by weight while maintaining the temperatures of the stems in a range of from about 115° to about 170° C. at a preselected pressure of 10 to 100 psig and then mechanically fiberizing the treated stems under such pressure by shredding. U.S. Pat. No. 4,195,646 issued to G. F. Kite on Apr. 1, 1980, teaches a method of shredding tobacco stems by splitting the stems lengthwise along the grain by supporting the stem shards in a fluid medium and striking the shards with a blunt instrument to separate such shards into fibrilliform shred fragments. In addition, U.S. Pat. No. 4,386,617 and UK Patent Application No. 2,078,085, published for inspection on 6 Jan. 1982, both to Warren Arthur Brackman, teach a method of soaking tobacco stems to provide a moisture content by weight of 30% to 60%, shredding the soaked stems and then drying the stems to a moisture content desired, the stems having been brought to a temperature up to the boiling point of water prior to such shredding step.

As can be seen from this aforediscussed prior art, it has long been known in the tobacco processing art, to shred tobacco stems which have been moistened to a preselected range and then to reduce the moisture content of the shreds to a desired level for the smoking article in which the shredded stems are to be included. The reduction of the stems to the desired moisture content has been accomplished by conventional drying means in the conventional manner to obtain the desired result.

A number of processes also are known in the art for heating and drying moistened tobacco particulates arrived at by cutting and rolling and by subjecting the particulates to heated gas streams held at preselected temperatures. For example, U.S. Pat. No. 3,357,436, issued on Dec. 12, 1967, to A. H. Wright and German-Ausleggeschrift 2,253,882, teach processes wherein moistened, cut tobacco ribs have been moistened in the range of from about 24% to 40% by weight and then dried by gases at a temperature of from 121° C. to 370° C. for brief periods of time ranging from 0.3 to 3 seconds to reach moisture contents by weight as low as 6% within a short period of time. U.S. Pat. No. 3,734,104, issued to Buchanan et al, on May 22, 1973, teaches the treating of rolled, crushed tobacco stems, which have been moistened to a content of about 24% to 60% by weight, with a hot gas stream containing at least 30% steam to heat the stems to about 0.5 to less than 3 seconds. Further, more recent U.S. Pat. No. 4,167,191, issued to John Jewell, et al, on Sept. 11, 1979, teaches a process of drying expanded cut tobacco at a temperature within the range of from about 250° F. to about 650° F. in the presence of an absolute humidity at a level above that which will provide a wet-bulb temperature of at least about 150° F.

As can be seen from the aforediscussed, these varying drying processes of the more recent past have been utilized in conjunction with cut tobacco leaf lamina and stems, all of which have been cut to a preselected size.

The present invention recognizes that it has been a desideratum of past tobacco stem shredding processes to optimize the economic use of the stems in smoking articles by converting the stems into a product suitable for inclusion as a smoking article filler with as high a fill value (FV) as possible. In addition, the present invention recognizes that it has been a desideratum of past high humidity drying as aforedescribed to reduce the moisture content of expanded tobacco generally to a desired level, while minimizing possible loss in filling power. By recognizing the aims of these two separate processing systems the present invention uniquely combines the several steps of each into a novel combination of steps to obtain fill values heretofore unknown in the art.

The present invention further provides a novel, economic and straightforward series of steps for treating tobacco stems to reduce their particulate size and yet at the same time to optimize their fill value for smoking article purposes.

Various other features of the present invention will become obvious to one skilled in the art upon reading the disclosure set forth hereinafter.

SUMMARY OF THE INVENTION

More particularly, the present invention provides a method for treating tobacco leaf stems to produce a product for use in smoking articles comprising the steps of: (1) adjusting the moisture content of the tobacco to be shredded to a preselected percentage by weight; (2) shredding the tobacco in a disc shredder controlling the specific energy imparted to the tobacco being shredded to an emperically predetermined value; and, (3) reducing the moisture content of the shredded stems by heating the stems in a gas having an initial temperature within the range of from about 250° F. to about 650° F. in the presence of an absolute humidity at a level above that which will provide a wet-bulb temperature reading of at least 150° F.

DETAILED DESCRIPTION OF THE PREFERRED EMBODIMENT

As a first step in the process, the tobacco to be shredded is moistened with water until the material has a moisture content in the range of about 50% to about 65% water by weight (wet basis) and advantageously from about 55% to about 60% water by weight.

The moistened tobacco is shredded in a disc shredder. Various disc shredders or refiners are known and can be used in the novel process of the invention. One known type of disc shredder or refiner has two spaced apart discs, one disc being stationary and the other disc being rotatable. Another known type disc shredder or refiner has two spaced apart discs, both being rotatable. It is also known that the spacing between the discs of the shredder or refiner has an effect on the size of the resulting particles of tobacco shredded by the disc shredder. However, merely controlling the spacing between the discs to produce a shredded tobacco does not provide adequate control over the quality (fill value and particle size) of the finished tobacco product resulting from the overall treating process. For example, at a constant gap or space setting between the shredder discs, a change in the tobacco feed rate through the shredder will result in a change in tobacco quality. Similarly, at a constant gap or space setting between the shredder discs, a change in disc rpm will result in a change in tobacco quality.

It has been determined that a number of shredder parameters affect the quality of the tobacco product. These parameters include, but are not necessarily limited to: The gap or space setting between the discs; power consumption of the disc shredder; rate of feed of the tobacco through the shredder; design of the plates, plate wear; rotating speed of the shredder disc; and type of tobacco being fed through the shredder.

Obviously, any attempt to determine and control each of these variable parameters, and combinations of these variable parameters, in order to produce a particular resulting tobacco product is impractical, if not impossible from a practical manufacturing standpoint. An attempt to do so would require the determination of gap setting as a function not only of each of the variable parameters mentioned above, but also as a function of various combinations and permutations thereof.

We have determined that gap setting as a function of these other variable disc shredder parameters can be ignored, and the quality (fill value and particle size) of the tobacco product resulting from the overall process can be best regulated by controlling the specific energy imparted to the tobacco being shredded by the disc shredder.

Specific energy is represented by the following equation.

| | |
|---|---|
| Specific energy = | Applied Energy/feed rate of tobacco through shredder |
| Wherein: | applied energy is measured as horsepower of the disc shredder in excess of idle horsepower at the given tobacco feed rate. feed rate is measured in pounds of bone dry tobacco. |

The specific energy of a particular disc shredder is empirically ascertained by testing the tobacco product resulting from the overall tobacco treating process and determining by instrumentation the specific energy imparted to the resulting tobacco product which resulted in the tobacco product qualities desired. A range of specific energy values resulting in the target or desired tobacco product qualities can thusly be determined. This only needs to be done once to establish the desired specific energy imput to the tobacco to obtain the target tobacco particle size and fill value. An operator controlling the process of the present invention then only needs to refer to the compiled desired specific energy data and make sure that the shredder is imparting a specific energy within the compiled desired range to the tobacco being processed. The operator need not be concerned with any of the variables of the shredder mentioned above.

Specific energy imparted to tobacco being shredded was empirically determined for two different size disc shredders. The results are tabulated in Table 1, below.

TABLE 1

PARTICLE SIZE vs. SPECIFIC ENERGY

| 36" diameter disc shredder | | 52" diameter disc shredder | |
|---|---|---|---|
| % of particles 6 mesh and above | Specific Energy | % of particles 6 mesh and above | Specific Energy |
| 67.2 | 0.0177 | 24.4 | 0.029 |
| 57.9 | 0.0193 | 18.3 | 0.031 |
| 46.6 | 0.0245 | 16.9 | 0.044 |
| 36.4 | 0.0589 | 8.2 | 0.077 |
| 29.2 | 0.0532 | | |
| 18.2 | 0.0655 | | |
| 9.0 | 0.136 | | |

It has been determined that a specific energy imparted to the tobacco by the disc shredder of from about 0.017 to about 0.136 hp.-hr per pound of bone dry tobacco yields the target quality (fill value and particle size) tobacco product resulting from the overall process of the present invention.

It has been also determined that the temperature of the moist tobacco to be shredded has an effect on the tobacco product processed by the present invention. Best results seem to result when the temperature of the tobacco fed to the disc shredder is in the range of about 75° F. to 210° F.

The shredded tobacco is then subjected to a high humidity drying process at ranges similar to that set forth in Jewell U.S. Pat. No. 4,167,191 for cut tobacco. Advantageously, in accordance with the present invention, the shredded tobacco is adjusted to a preselected inlet temperature in the range of about 60° F. to about 212° F. and the moisture content of the shredded tobacco in the present invention is reduced by heating the treated material in a mixture of air and water vapor of initially from about 250° F. to about 650° F. - advantageously at about 500° F. - in the presence of an absolute humidity at a level of at least 150° F. - advantageously at a wet-bulb reading of 210° F. It also has been found to be advantageous to dry the shredded tobacco in the aforedescribed process until the moisture content is about 5% to 25% by weight and, more particularly, to about 14% by weight to yield a very satisfactory resulting tobacco product.

Alternatively to drying the shredded tobacco to 14% by weight, it has been determined that additional fill value improvement can be obtained by overdrying the shredded tobacco using the high humidity drying process described above to from about 6% to about 10% moisture content by weight, and subsequently reordering the resulting tobacco product to about 14% moisture content by weight. The results of this alternative high humidity overdrying to from 6% to 10%-moisture content and reordering to 14% moisture content compared to the high humidity drying of the tobacco to 14% moisture content can be seen in the following table.

TABLE 2

EFFECT OF OVERDRYING AND IN-LINE REORDERING ON HIGH HUMIDITY DRIED TOBACCO

| | CONTROL | SAMPLE A | SAMPLE B |
|---|---|---|---|
| Exit Dryer Moisture (%) | 14 | 10 | 6 |
| Exit Reordering Moisture (%) | not applicable | 12 | 13 |
| Borgwaldt Fill Value (cc/g) | 6.9 | 7.2 | 8.7 |
| Particle size Distribution | | | |
| +6M (%) | 17.8 | 26.0 | 20.1 |
| −14M (%) | 47.5 | 41.5 | 41.7 |

Two samples of tobacco product were prepared, each consisting of a blend of about 52% flue cured tobacco stem and 48% burley tobacco stem. Both samples 1 and 2 were moistened to an initial moisture content of about 55% by weight and shredded in a disc shredder imparting the same specific energy to each sample. Sample 1 was further processed through the high humidity drying process step of the present invention to a resulting moisture content of about 14% by weight. Sample 2 was further processed in accordance with U.S. Pat. No. 4,386,617. Cigarettes having 188 mg/cc were made from Samples 1 and 2.

The cigarettes of Samples 1 and 2 were tested for tobacco section pressure drop (P.D.) with the results shown in the following table.

TABLE 3

EFFECT OF HIGH HUMIDITY DRYING ON CIGARETTE PRESSURE DROP OF *85mm LENGTH CIGARETTES

| | Tobacco Section Pressure Drop (cm. of $H_2O$) |
|---|---|
| Sample 1: | 13.0 |
| Sample 2: | 5.2 |

*Data extrapolated from 63 mm cigarettes.

The cigarettes of Samples 1 and 2 were also tested for burn rate, puff count, and CO delivery with the results shown in the following table.

TABLE 4

EFFECT OF HIGH HUMIDITY DRYING ON CIGARETTE BURN RATE; PUFF COUNT; CO DELIVERY OF 63 mm LENGTH CIGARETTES

| | Burn Rate (mg/minute) | Puff Count | CO (mg/puff) |
|---|---|---|---|
| Sample 1: | 56 | 6.1 | 1.9 |
| Sample 2: | 69 | 5.3 | 2.2 |

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A method of treating tobacco to produce a product for use in smoking articles comprising the steps of:

adjusting the moisture content of the tobacco to be shredded to a preselected percentage by weight;

shredding the tobacco in a disc shredder controlling the specific energy imparted to the tobacco being shredded to a predetermined value; and, reducing the moisture content of the shredded tobacco by heating the shredded tobacco in a gas having an initial temperature within the range of from about 250° F. to about 650° F. in the presence of an absolute humidity at a level above that which will provide a wet-bulb temperature reading of at least 150° F.

2. The method of claim 1, wherein the wet-bulb temperature reading is about 180° F.

3. The method of claim 1, wherein the initial gas temperature is about 500° F. and the wet-bulb temperature reading is at least about 180° F.

4. The method of claim 1, wherein the moisture content of the shredded tobacco is reduced to from about 5% to about 25% by weight.

5. The method of claim 4, wherein the moisture content of the shredded tobacco is reduced to about 14% by weight.

6. The method of claim 4, wherein:

the moisture content of the shredded tobacco is reduced to from about 6% to about 10% by weight; and, the moisture content is subsequently reordered to about 14% by weight.

7. The method of claim 1, wherein the moisture content of the tobacco to be shredded is adjusted to a moisture content of from about 50% to about 65% by weight.

8. The method of claim 7, wherein the moisture content of the tobacco to be shredded is adjusted to a moisture content of from about 55% to about 60% by weight.

9. The method of claim 1, wherein the specific energy imparted by the disc shredded to the tobacco being shredded is from about 0.017 to about 0.136 hp-hr. per pound of bone dry tobacco.

10. The method of claim 1, further comprising the step of controlling the temperature of the tobacco to be shredded to from about 75° F. to 210° F.

* * * * *